US009334824B2

(12) United States Patent
Pursifull et al.

(10) Patent No.: US 9,334,824 B2
(45) Date of Patent: May 10, 2016

(54) METHOD AND SYSTEM FOR CHARACTERIZING A PORT FUEL INJECTOR

(71) Applicant: Ford Global Technologies, LLC, Dearborn, MI (US)

(72) Inventors: Ross Dykstra Pursifull, Dearborn, MI (US); Joseph Lyle Thomas, Kimball, MI (US); Gopichandra Surnilla, West Bloomfield, MI (US); Daniel Dusa, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 289 days.

(21) Appl. No.: 14/192,768

(22) Filed: Feb. 27, 2014

(65) Prior Publication Data

US 2015/0240739 A1 Aug. 27, 2015

(51) Int. Cl.

| | |
|---|---|
| ***F02D 41/30*** | (2006.01) |
| ***F02D 41/00*** | (2006.01) |
| ***F02D 41/22*** | (2006.01) |
| ***F02D 41/38*** | (2006.01) |

(52) U.S. Cl.

CPC ..... *F02D 41/3094* (2013.01); *F02D 41/008* (2013.01); *F02D 41/221* (2013.01); *F02D 41/3845* (2013.01); *F02D 2041/3881* (2013.01); *F02D 2200/0602* (2013.01)

(58) Field of Classification Search

CPC ..... F02D 1/00; F02D 41/30; F02D 19/0623; F02D 19/0626; F02D 19/0628; F02D 33/003; F02D 2041/224; F02D 2041/26; F02M 37/08; F02M 65/003; F02M 69/16; F02M 2037/087

USPC ..... 123/445, 446, 495, 497, 198 C, 198 D, 123/198 DC; 701/101, 103, 104

See application file for complete search history.

(56) References Cited

U.S. PATENT DOCUMENTS

| | | | | |
|---|---|---|---|---|
| 5,201,294 | A * | 4/1993 | Osuka | F02D 41/221 123/198 D |
| 7,640,916 | B2 | 1/2010 | Ulrey et al. | |
| 7,841,319 | B2 | 11/2010 | Thomas | |
| 7,886,719 | B2 * | 2/2011 | Thomas | F02D 41/402 123/299 |
| 8,118,006 | B2 | 2/2012 | Pursifull | |
| 8,364,384 | B2 * | 1/2013 | Pursifull | F02D 41/0027 123/299 |
| 8,776,764 | B2 * | 7/2014 | Basmaji | F02D 19/0605 123/27 GE |
| 8,857,412 | B2 * | 10/2014 | Nistler | F02D 41/22 123/198 D |
| 2013/0013174 | A1 * | 1/2013 | Nistler | F02D 41/123 701/112 |
| 2013/0275026 | A1 * | 10/2013 | Methil-Sudhakaran | F02M 65/003 701/103 |

* cited by examiner

*Primary Examiner* — Grant Moubry

(74) *Attorney, Agent, or Firm* — Julia Voutyras; Alleman Hall McCoy Russell & Tuttle LLP

(57) ABSTRACT

Various systems and methods are described for calibrating a port injector of a common fuel, dual injector per cylinder engine which includes first and second fuel rails and first and second fuel pumps. In one example, after pressurizing both fuel rails and suspending operation of the two pumps simultaneously, a single cylinder is fueled by a port injector while the remaining cylinders are fueled via their respective direct injectors. Fuel rail pressure drops are measured in the rail coupled to the port injector and correlated to port injector performance.

20 Claims, 8 Drawing Sheets

METHOD AND SYSTEM FOR CHARACTERIZING A PORT FUEL INJECTOR

TECHNICAL FIELD

The present application relates to diagnosing port fuel injector variability in an engine configured with port and direct injection of fuel to each cylinder.

BACKGROUND AND SUMMARY

Fuel injectors often have piece-to-piece and time-to-time variability, due to imperfect manufacturing processes and/or injector aging, for example. Over time, injector performance may degrade (e.g., injector becomes clogged) which may further increase piece-to-piece injector variability. As a result, the actual amount of fuel injected to each cylinder of an engine may not be the desired amount and the difference between the actual and desired amounts may vary between injectors. Such discrepancies can lead to reduced fuel economy, increased tailpipe emissions, and an overall decrease in engine efficiency. Further, engines operating with a dual injector system, such as a combination of port fuel injection (PFI) and direct injection (DI) systems, may have even more fuel injectors (e.g., twice as many) resulting in a greater possibility of a decline in engine performance due to injector degradation.

One example diagnostic method is shown by Pursifull in U.S. Pat. No. 8,118,006 wherein direct injector variability in a dual fuel engine is evaluated by isolating one fuel injector at a time. Therein, pumping of a second fuel into a second fuel rail is suspended while a first, different fuel is direct injected to all but a single cylinder of the engine. While pumping is suspended in the second fuel rail, the second fuel is direct injected into the single cylinder via the injector being calibrated and a pressure decrease in the second fuel rail is correlated to direct injector health. Specifically, if the measured pressure drop is higher or lower than an expected decrease in pressure, direct injector malfunction due to issues such as injector plugging, injector leakage and/or a complete failure of the injector is established. As such, this approach allows a single injector's effect to be isolated and assessed.

The inventors herein have identified a potential issue with the above approach. Specifically, the approach of Pursifull may not be usable to reliably diagnose a port injector. The method of Pursifull diagnoses direct injectors in a dual fuel system where each fuel rail is coupled to a separate lift pump, high pressure pump, and fuel tank, and where each fuel rail may be independently pressurized and supplied with fuel. To diagnose a given direct injector, the high pressure pump of the corresponding fuel rail is disabled while maintaining operation of the lift pump. Thus, even if port injectors were present in the system of Pursifull, port injection of fuel would not be affected by the disabling of the high pressure pump. However, to diagnose a port injector, the fuel rail coupled to the port injector should not receive or disburse any fuel during the measurement window in order to reduce interfering physics from the measurement event. This would require suspending operation of the lift pump to diagnose the port injector. However, since the lift pump supplies fuel for further pressurization to the high pressure pump, disabling the lift pump could negatively affect the operation of the high pressure pump, and thereby the fueling of the cylinders via the direct injectors. As a result, the port injector may not be diagnosed non-intrusively.

The inventors herein have recognized that, unlike the lift pump system, where the fuel is pressurized due to an incompressible fluid within a compliant conduit, the high pressure pump system is effectively rigid, as appropriate for a high pressure fuel system. The fuel pressure storage in the high pressure system is due to the fuel's bulk modulus. In other words, the fuel's density is increased to increase stored fuel in the rail and this density increase is sensed via fuel rail pressure. Consequently, if the fuel rail pressure of fuel rail coupled to the direct injectors is set sufficiently high (e.g., at a maximum permissible level), the high pressure pump can be transiently turned off even while the direct injectors are supplying fuel to the engine. Thus, in one example approach, a method is provided to evaluate the performance of a port injector in a dual injector, single fuel system including first and second fuel rails. The method comprises pressurizing a first fuel rail with each of a first and a second pump, pressurizing a second fuel rail with only the first pump and after suspending operation of both pumps concurrently, injecting a common fuel via a single port injector coupled to the second fuel rail into a single cylinder, and correlating pressure drops in the second fuel rail to injector operation. In this way, a port injector may be isolated and diagnosed without affecting fuel injection via a direct injector.

In one example, an electronic returnless lift pump within a fuel tank may be pulsed at full voltage to pressurize fuel to a threshold pressure (e.g., a maximum pressure) within the fuel system including a low pressure rail coupled to port injectors. A high pressure pump coupled to a high pressure fuel rail and direct injectors may then be operated to raise fuel rail pressure to a threshold pressure (e.g., a maximum pressure). Thereafter, operation of both pumps may be suspended, for example, simultaneously. The port injector of a single cylinder may then be diagnosed by fueling via said port injector while remaining cylinders are fueled via their respective direct injectors. After each port injection, a pressure decrease in the low pressure fuel rail coupled to the port injector may be measured and compared to a predetermined value. Any deviation in the measured pressure drop may be correlated with injector health. In addition, a change in high pressure fuel rail may be monitored. If the high pressure fuel rail drops below a threshold pressure (such as a minimum pressure required to meet injection requirements), port injector diagnostics may be temporarily disabled. As such, due to relatively faster dissipation of pressure from the high pressure fuel rail due to direct injection of multiple injectors (versus port injection to a single port injector during port injector diagnostics), the lift pump and high pressure pump may need to be intermittently re-enabled. Each of the lift pump and high pressure fuel pumps may then be operated to return the fuel rails to their respective threshold pressures, after which port injector diagnostics can be resumed. Fuel injection via the port injector may be subsequently performed with a correction learned during the port injector characterization.

In this way, a port injector can be isolated in a single fuel system further including a direct injector in each cylinder and pressure drops in a low pressure fuel rail can be correlated with port injector degradation. By concomitantly pressurizing a high pressure fuel rail coupled to cylinder direct injectors, the fuel's bulk modulus can be advantageously used to maintain pressure in the fuel rail and the direct injectors can supply fuel to the engine even when a lift pump and high pressure pump are shut down. By suspending operation of the lift pump, a control volume may exist in the low pressure plumbing system such that any pressure drop in this system can be assigned to the single port injector being diagnosed. By periodically disabling port injector diagnostics to sufficiently re-pressurize the high pressure fuel rail, cylinder direct fuel injection may be continued when the diagnostics are resumed without operating any fuel pump. Thus, injector-to-injector variability amongst port injectors may be measured on-engine in a non-intrusive manner without significantly affecting engine operation. Individual injectors may be diagnosed and variations in fuel injection may be corrected, thus improving fuel economy and emissions. By diagnosing a single port injector at a time, the air-fuel ratio per cylinder may be individually adjusted, resulting in improved engine control with all cylinders operating at a desired air-fuel ratio.

As such, this approach can also be applied to gaseous fuel systems. However, in gaseous fuel systems, there may be a temperature drop concomitant with the pressure drop that needs to be compensated for. In addition, the approach may need to be modified given that gaseous fuel plumbing has a fuel lock-off solenoid valve in place of a fuel pump.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
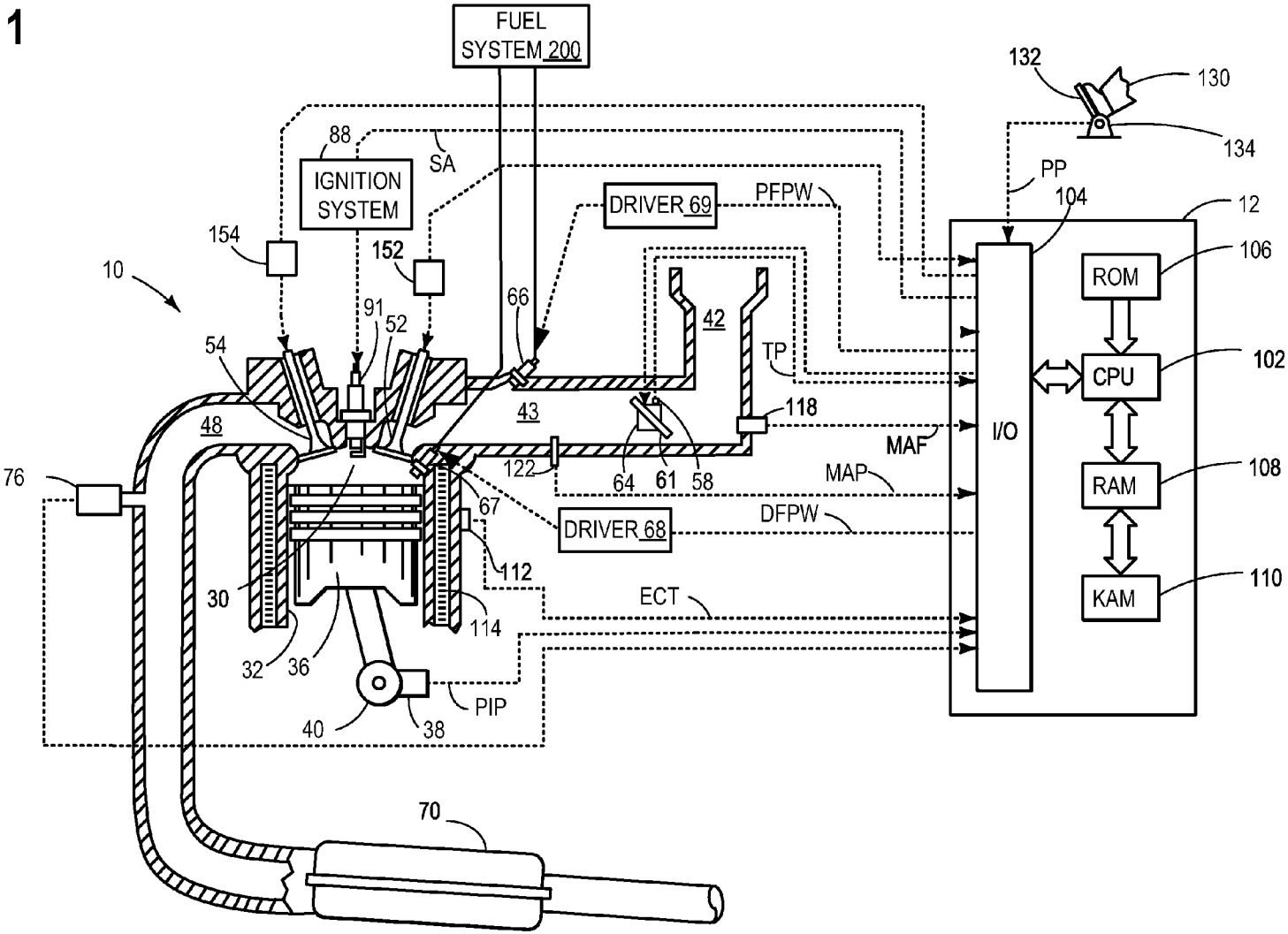
FIG. 1 portrays a schematic diagram of an engine.
Figure 2:
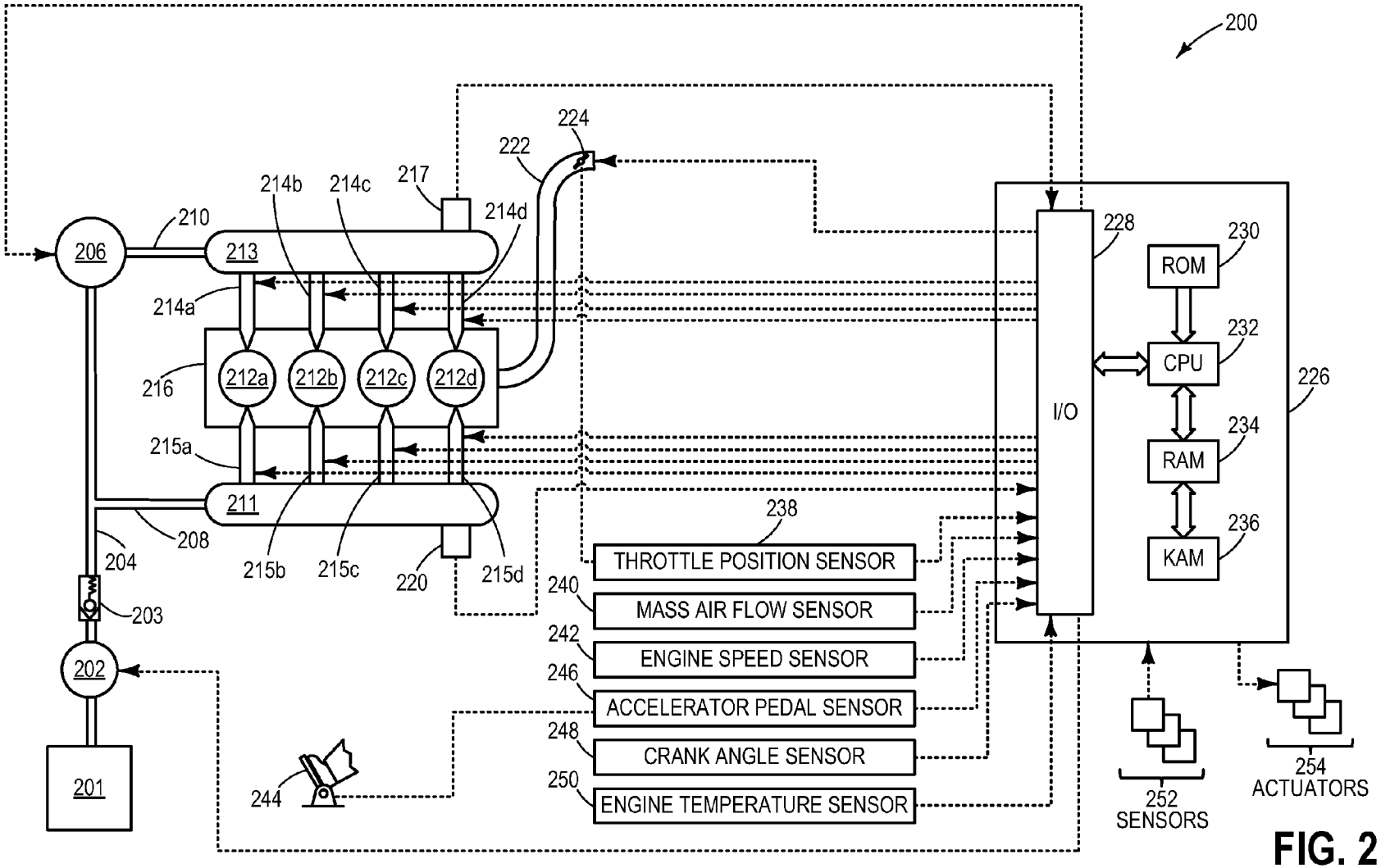
FIG. 2 depicts a schematic diagram of a dual injector, single fuel system coupled to the engine of FIG. 1.
Figure 6A:
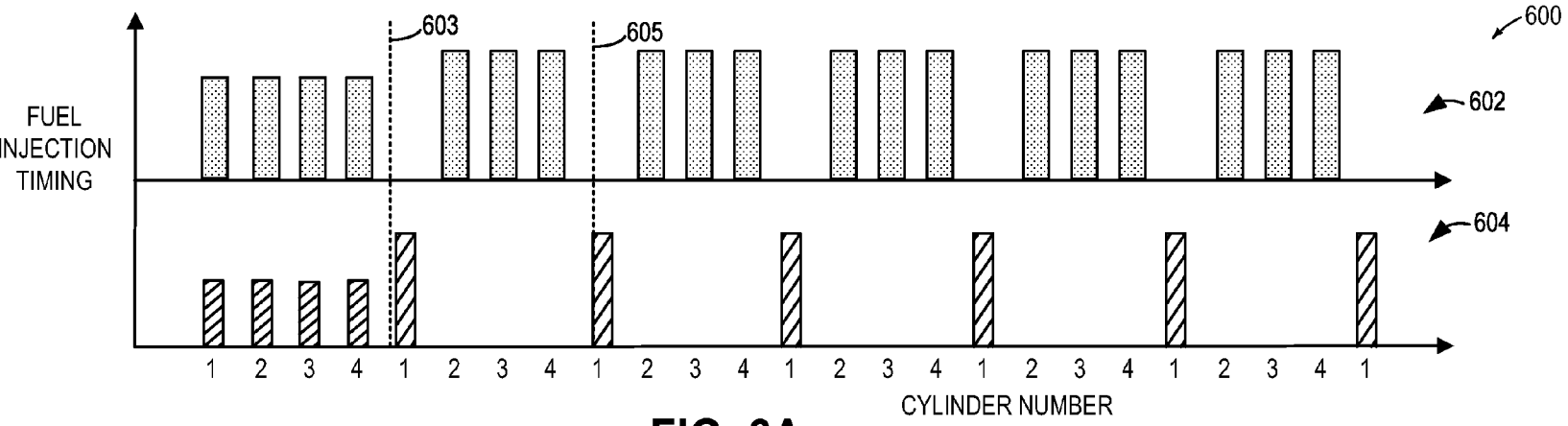
FIGS. 6A and 6B show an example fuel injection timing and fuel rail pressure change during a diagnostic routine, respectively.
Figure 6B:
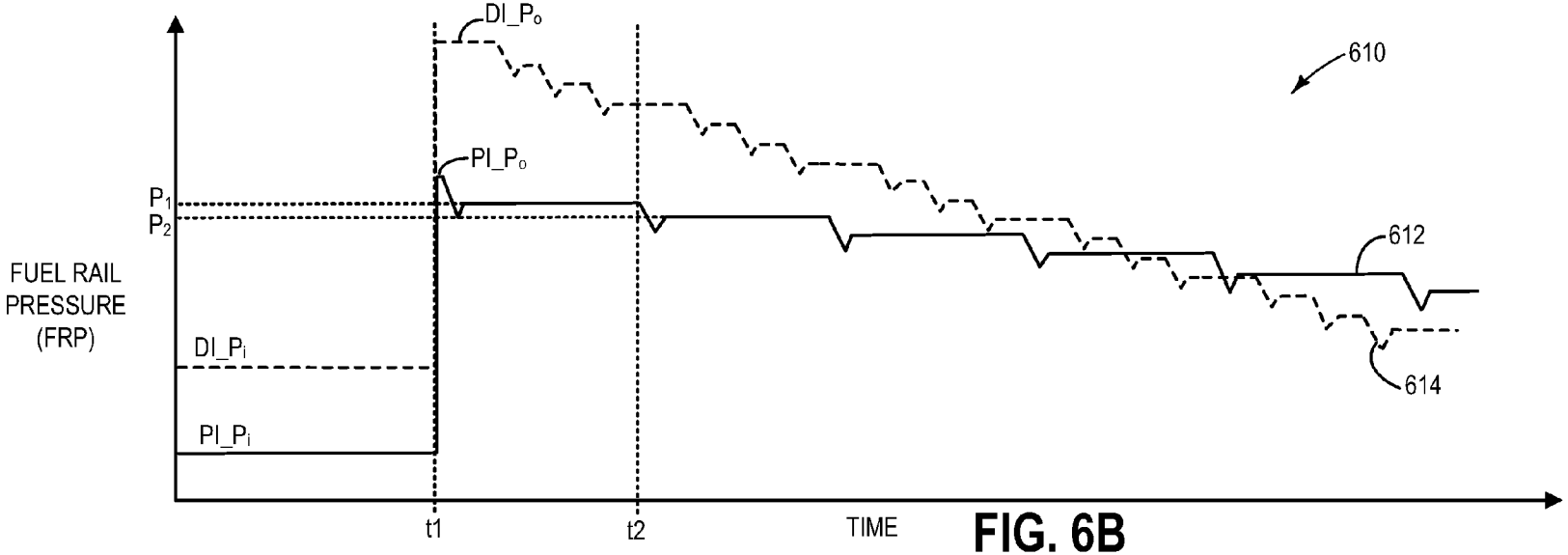
Figure 7:
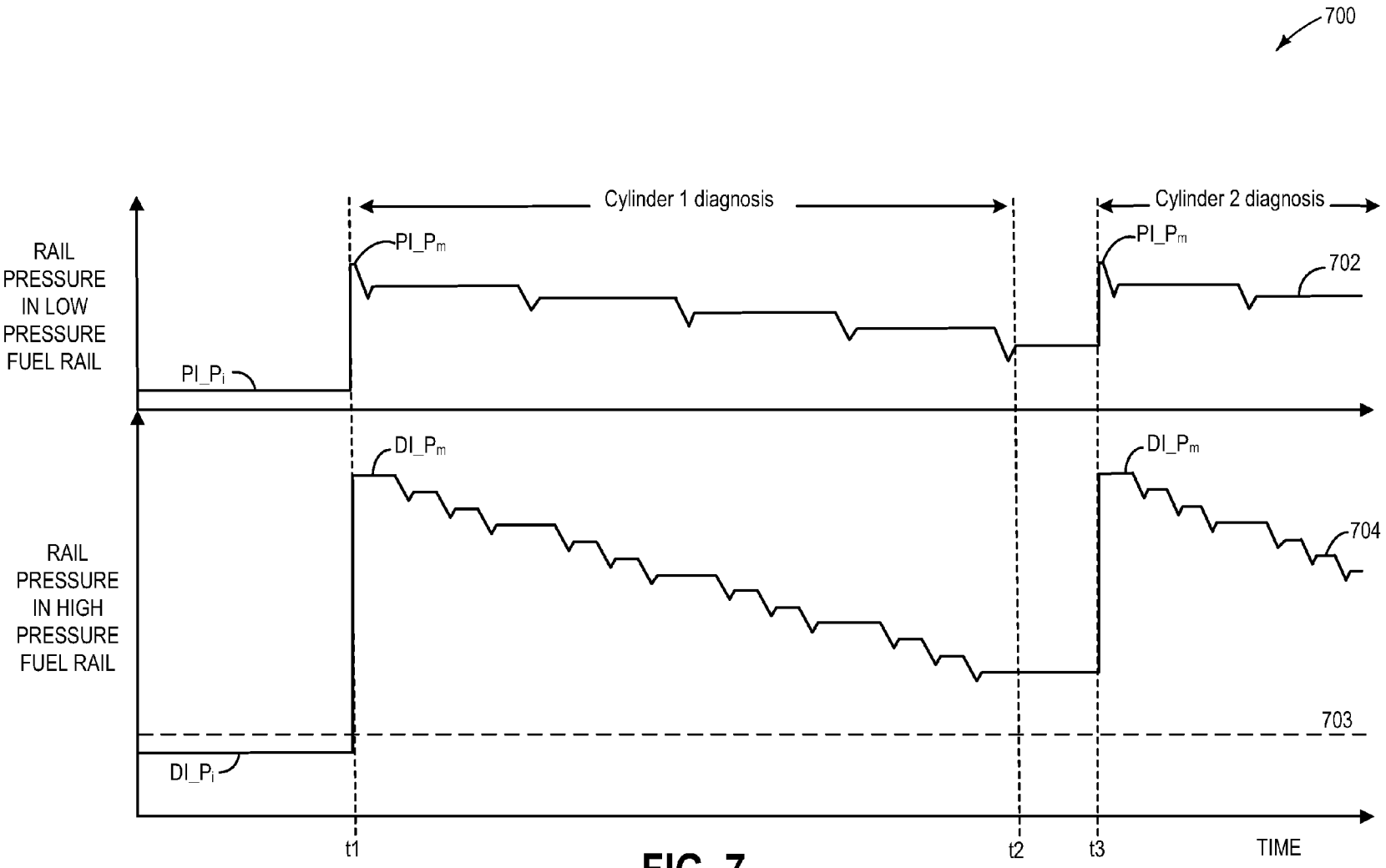
FIG. 7 demonstrates an example port injector characterization process that is completed.
Figure 8:
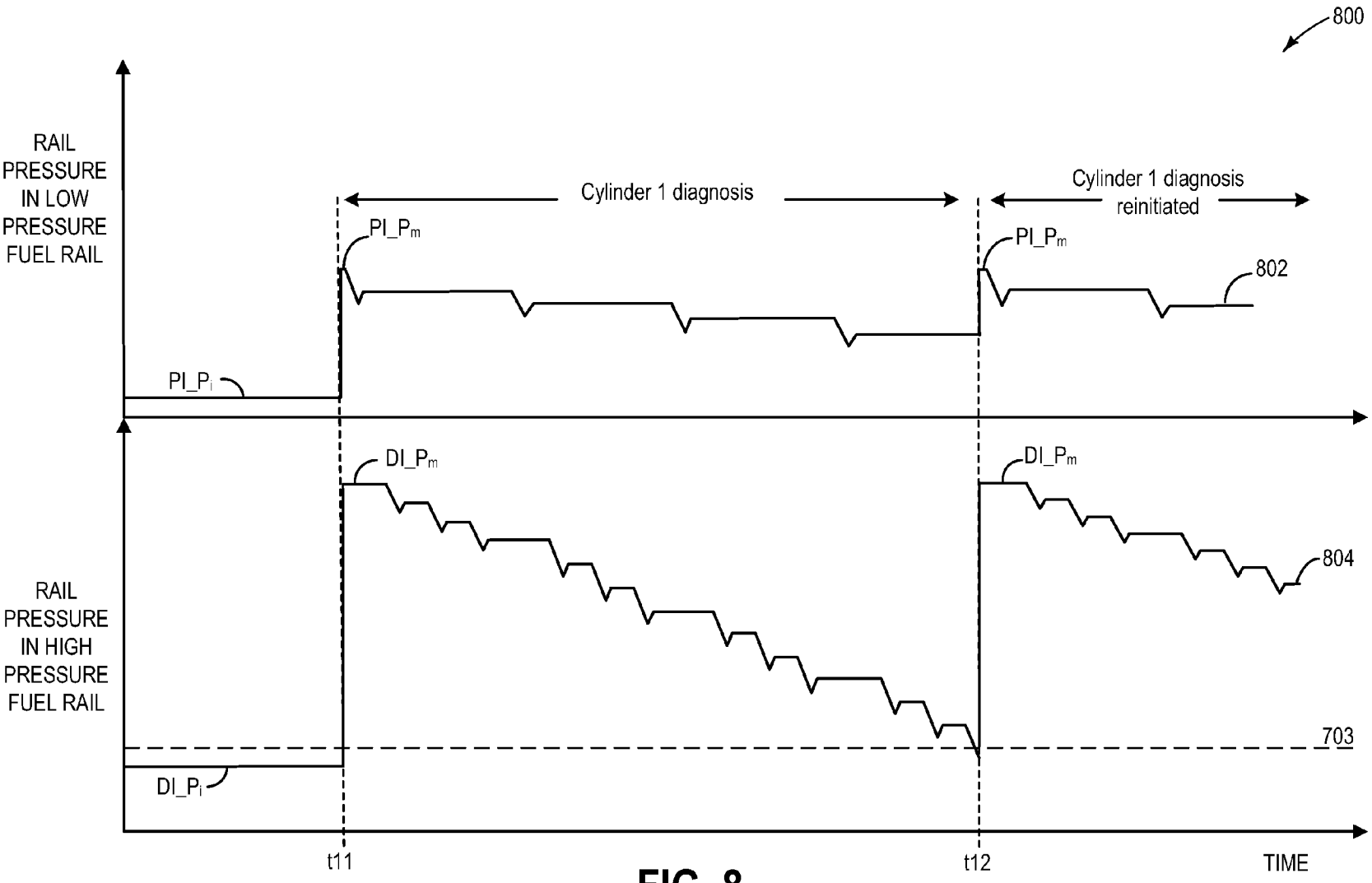
FIG. 8 demonstrates an example port injector characterization process that is disabled due to pressure changes at a high pressure fuel rail and is subsequently reinitiated.

The following description relates to a method for characterizing a port injector in a dual injector, single fuel engine system, such as the system of FIGS. 1-2 which includes first and second fuel rails and first and second fuel pumps as shown in FIG. 2. An example engine system with two fuel injectors per cylinder, including one port injector and one direct injector is shown at FIGS. 1-2. A controller may be configured to perform control routines to confirm the need for an injector calibration, diagnose a fuel injector while maintaining engine operation and correlate a measured fuel rail pressure drop to injector operation, such as shown in the example routines of FIGS. 3-5 respectively. After sufficiently pressurizing each of a low pressure and a high pressure fuel rail, a port injector in a single cylinder may be diagnosed while the remaining engine cylinders are fueled by their respective direct injectors. As the single cylinder is port injected with fuel, a pressure drop in the corresponding fuel rail may be monitored to assess port injector health, as shown at FIGS. 6A and 6B. A high pressure fuel rail may be maintained above a threshold during the diagnostics by disabling the port injector diagnostic routine and repressurizing the high pressure fuel rail as often as required. Example injector diagnostic operations are shown at FIGS. 7-8.

FIG. 1 shows a schematic depiction of a spark ignition internal combustion engine 10 with a dual injector system, where engine 10 has both direct and port fuel injection. Engine 10 comprises a plurality of cylinders of which one cylinder 30 (also known as combustion chamber 30) is shown in FIG. 1. Cylinder 30 of engine 10 is shown including combustion chamber walls 32 with piston 36 positioned therein and connected to crankshaft 40. A starter motor (not shown) may be coupled to crankshaft 40 via a flywheel (not shown), or alternatively, direct engine starting may be used.

Combustion chamber 30 is shown communicating with intake manifold 43 and exhaust manifold 48 via intake valve 52 and exhaust valve 54, respectively. In addition, intake manifold 43 is shown with throttle 64 which adjusts a position of throttle plate 61 to control airflow from intake passage 42.

Intake valve 52 may be operated by controller 12 via actuator 152. Similarly, exhaust valve 54 may be activated by controller 12 via actuator 154. During some conditions, controller 12 may vary the signals provided to actuators 152 and 154 to control the opening and closing of the respective intake and exhaust valves. The position of intake valve 52 and exhaust valve 54 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 30 may alternatively include an intake valve controlled via electric valve actuation and an exhaust valve controlled via cam actuation including CPS and/or VCT. In other embodiments, the intake and exhaust valves may be controlled by a common valve actuator or actuation system, or a variable valve timing actuator or actuation system.

In another embodiment, four valves per cylinder may be used. In still another example, two intake valves and one exhaust valve per cylinder may be used.

Combustion chamber 30 can have a compression ratio, which is the ratio of volumes when piston 36 is at bottom center to top center. In one example, the compression ratio may be approximately 9:1. However, in some examples where different fuels are used, the compression ratio may be increased. For example, it may be between 10:1 and 11:1 or 11:1 and 12:1, or greater.

In some embodiments, each cylinder of engine 10 may be configured with one or more fuel injectors for providing fuel thereto. As shown in FIG. 1, cylinder 30 includes two fuel injectors, 66 and 67. Fuel injector 67 is shown directly coupled to combustion chamber 30 for delivering injected fuel directly therein in proportion to the pulse width of signal DFPW received from controller 12 via electronic driver 68. In this manner, direct fuel injector 67 provides what is known as direct injection (hereafter referred to as "DI") of fuel into combustion chamber 30. While FIG. 1 shows injector 67 as a side injector, it may also be located overhead of the piston, such as near the position of spark plug 91. Such a position may improve mixing and combustion due to the lower volatility of some alcohol based fuels. Alternatively, the injector may be located overhead and near the intake valve to improve mixing.

Fuel injector 66 is shown arranged in intake manifold 43 in a configuration that provides what is known as port injection of fuel (hereafter referred to as "PFI") into the intake port upstream of cylinder 30 rather than directly into cylinder 30. Port fuel injector 66 delivers injected fuel in proportion to the pulse width of signal PFPW received from controller 12 via electronic driver 69.

Fuel may be delivered to fuel injectors 66 and 67 by a high pressure fuel system 200 including a fuel tank, fuel pumps, and fuel rails (elaborated at FIG. 2). Further, as shown in FIG. 2, the fuel tank and rails may each have a pressure transducer providing a signal to controller 12.

Exhaust gases flow through exhaust manifold 48 into emission control device 70 which can include multiple catalyst bricks, in one example. In another example, multiple emission control devices, each with multiple bricks, can be used. Emission control device 70 can be a three-way type catalyst in one example.

Exhaust gas sensor 76 is shown coupled to exhaust manifold 48 upstream of emission control device 70 (where sensor 76 can correspond to a variety of different sensors). For example, sensor 76 may be any of many known sensors for providing an indication of exhaust gas air/fuel ratio such as a linear oxygen sensor, a UEGO, a two-state oxygen sensor, an EGO, a HEGO, or an HC or CO sensor. In this particular example, sensor 76 is a two-state oxygen sensor that provides signal EGO to controller 12 which converts signal EGO into two-state signal EGOS. A high voltage state of signal EGOS indicates exhaust gases are rich of stoichiometry and a low voltage state of signal EGOS indicates exhaust gases are lean of stoichiometry. Signal EGOS may be used to advantage during feedback air/fuel control to maintain average air/fuel at stoichiometry during a stoichiometric homogeneous mode of operation. A single exhaust gas sensor may serve 1, 2, 3, 4, 5, or other number of cylinders.

Distributorless ignition system 88 provides ignition spark to combustion chamber 30 via spark plug 91 in response to spark advance signal SA from controller 12.

Controller 12 may cause combustion chamber 30 to operate in a variety of combustion modes, including a homogeneous air/fuel mode and a stratified air/fuel mode by controlling injection timing, injection amounts, spray patterns, etc. Further, combined stratified and homogenous mixtures may be formed in the chamber. In one example, stratified layers may be formed by operating injector 66 during a compression stroke. In another example, a homogenous mixture may be formed by operating one or both of injectors 66 and 67 during an intake stroke (which may be open valve injection). In yet another example, a homogenous mixture may be formed by operating one or both of injectors 66 and 67 before an intake stroke (which may be closed valve injection). In still other examples, multiple injections from one or both of injectors 66 and 67 may be used during one or more strokes (e.g., intake, compression, exhaust, etc.). Even further examples may be where different injection timings and mixture formations are used under different conditions, as described below.

Controller 12 can control the amount of fuel delivered by fuel injectors 66 and 67 so that the homogeneous, stratified, or combined homogenous/stratified air/fuel mixture in chamber 30 can be selected to be at stoichiometry, a value rich of stoichiometry, or a value lean of stoichiometry.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including measurement of inducted mass air flow (MAF) from mass air flow sensor 118; engine coolant temperature (ECT) from temperature sensor 112 coupled to cooling sleeve 114; a profile ignition pickup signal (PIP) from Hall effect sensor 38 coupled to crankshaft 40; and throttle position TP from throttle position sensor 58 and an absolute Manifold Pressure Signal MAP from sensor 122. Engine speed signal RPM is generated by controller 12 from signal PIP in a conventional manner and manifold pressure signal MAP from a manifold pressure sensor provides an indication of vacuum, or pressure, in the intake manifold. During stoichiometric operation, this sensor can give an indication of engine load. Further, this sensor, along with engine speed, can provide an estimate of charge (including air) inducted into the cylinder. In one example, sensor 38, which is also used as an engine speed sensor, produces a predetermined number of equally spaced pulses every revolution of the crankshaft.

As described above, FIG. 1 merely shows one cylinder of a multi-cylinder engine, and that each cylinder has its own set of intake/exhaust valves, fuel injectors, spark plugs, etc. Also, in the example embodiments described herein, the engine may be coupled to a starter motor (not shown) for starting the engine. The starter motor may be powered when the driver turns a key in the ignition switch on the steering column, for example. The starter is disengaged after engine start, for example, by engine 10 reaching a predetermined speed after a predetermined time. Further, in the disclosed embodiments, an exhaust gas recirculation (EGR) system may be used to route a desired portion of exhaust gas from exhaust manifold 48 to intake manifold 43 via an EGR valve (not shown). Alternatively, a portion of combustion gases may be retained in the combustion chambers by controlling exhaust valve timing.

FIG. 2 illustrates a dual injector, single fuel system 200 with a high pressure and a low pressure fuel rail system which may be the fuel system coupled to engine 10 in FIG. 1, for example. Fuel system 200 may include fuel tank 201, low pressure or lift pump 202 that supplies fuel from fuel tank 201 to high pressure fuel pump 206 via low pressure passage 204. Lift pump 202 also supplies fuel at a lower pressure to low pressure fuel rail 211 via low pressure passage 208. Thus, low pressure fuel rail 211 is coupled exclusively to lift pump 202. Fuel rail 211 supplies fuel to port injectors 215*a*, 215*b*, 215*c* and 215*d*. High pressure fuel pump 206 supplies pressurized fuel to high pressure fuel rail 213 via high pressure passage 210. Thus, high pressure fuel rail 213 is coupled to each of a high pressure pump (206) and a lift pump (202).

High pressure fuel rail 213 supplies pressurized fuel to fuel injectors 214*a*, 214*b*, 214*c*, and 214*d*. The fuel rail pressure in fuel rails 211 and 213 may be monitored by pressure sensors 220 and 217 respectively. Lift pump 202 may be, in one example, an electronic return-less pump system which may be operated intermittently in a pulse mode. In other embodiments, un-injected fuel may be returned to fuel tanks 201*a* and 201*b* via respective fuel return passages (not shown). The engine block 216 may be coupled to an intake pathway 222 with an intake air throttle 224.

Lift pump 202 may be equipped with a check valve 203 so that the low pressure passages 204 and 208 (or alternate compliant element) hold pressure while lift pump 202 has its input energy reduced to a point where it ceases to produce flow past the check valve 203.

Direct fuel injectors 214*a-d* and port fuel injectors 215*a-d* inject fuel, respectively, into engine cylinders 212*a*, 212*b*, 212*c*, and 212*d* located in an engine block 216. Each cylinder, thus, can receive fuel from two injectors where the two injectors are placed in different locations. For example, as discussed earlier in FIG. 1, one injector may be configured as a direct injector coupled so as to fuel directly into a combustion chamber while the other injector is configured as a port injector coupled to the intake manifold and delivers fuel into the intake port upstream of the intake valve. Thus, cylinder 212*a* receives fuel from port injector 215*a* and direct injector 214*a* while cylinder 212*b* receives fuel from port injector 215*b* and direct injector 214*b*.

The system may further include a control unit 226. Control unit 226 may be an engine control unit, powertrain control unit, control system, a separate unit, or combinations of various control units. The control unit 226 is shown in FIG. 2 as a microcomputer, including an input/output (I/O) port 228, a central processing unit (CPU) 232, an electronic storage medium for executable programs and calibration values shown as read only memory (ROM) chip 230 in this particular example, random access memory (RAM) 234, keep alive memory (KAM) 236, and a data bus.

Similar to controller 12 in FIG. 1, control unit 226 may be further coupled to various other sensors 252 and various actuators 254 (e.g., fuel injection actuator, spark ignition actuator, throttle valve actuator, etc.) for sensing and controlling vehicle operating conditions. For example, the control unit 226 may receive fuel pressure signals from fuel pressure sensors 220 and 217 coupled to fuel rails 211 and 213 respectively. Fuelrails 211 and 213 may also contain one or more temperature sensors for sensing the fuel temperature within the fuel rails. The control unit 226 may also control operations of intake and/or exhaust valves or throttles, engine cooling fan, spark ignition, injector, and fuel pumps 202 and 206 to control engine operating conditions.

The control unit may further receive throttle opening angle signals indicating the intake air throttle position via a throttle position sensor 238, intake air flow signals from a mass air flow sensor 240, engine speed signals from engine speed sensor 242, accelerator pedal position signal from a pedal 244 via an accelerator pedal position sensor 246, crank angle sensor 248, and engine coolant temperature (ECT) signals from engine temperature sensor 250.

In addition to the signals mentioned above, the control unit 226 may also receive other signals from various other sensors 252. For example, the control unit 226 may receive a profile ignition pickup signal (PIP) from a Hall effect sensor (not shown) coupled to a crankshaft and a manifold pressure signal MAP from a manifold pressure sensor, as shown in FIG. 1.

The control unit 226 may control operations of various vehicular components via various actuators 254. For example, the control unit 226 may control the operation of the fuel injectors 214*a-d* and 215*a-d* through respective fuel injector actuators (not shown), and lift pump 202 and high pressure fuel pump 206 through respective fuel pump actuators (not shown).

Fuel pumps 202 and 206 may be controlled by the control unit 226 as shown in FIG. 2. The control unit 226 may regulate the amount or speed of fuel to be fed into fuel rails 211 and 213 by lift pump 202 and high pressure fuel pump 206 through respective fuel pump controls (not shown). The control unit 226 may also completely stop fuel supply to the fuel rails 211 and 213 by shutting down pumps 202 and 206.

Injectors 214*a-d* and 215*a-d* may be operatively coupled to and controlled by a control unit, such as control unit 226, as is shown in FIG. 2. An amount of fuel injected from each injector and the injection timing may be determined by the control unit 226 from an engine map stored in the control unit 226 on the basis of engine speed and/or intake throttle angle, or engine load. Each injector may be controlled via an electromagnetic valve coupled to the injector (not shown).

Various modifications or adjustments may be made to the above example systems. For example, the fuel passages (e.g., 204, 208, and 210) may contain one or more filters, pressure sensors, temperature sensors, and/or relief valves. The fuel passages may include one or more fuel cooling systems.

Thus, it is possible for controller 12 or control unit 226 to control the fueling of individual cylinders or groups of cylinders. As elaborated below, one port injector of a single cylinder may be sequentially isolated for calibration while the other cylinders continue to receive fuel from other direct injectors, thereby, leaving engine operation significantly unaffected during calibration. Further, any changes in fuel rail pressure (FRP) during calibration may be monitored by pressure sensors coupled to the fuel rails allowing for an evaluation of the injector's performance. Fuel injection via the diagnosed injector may then be adjusted based on the characterization.

Figure 3:
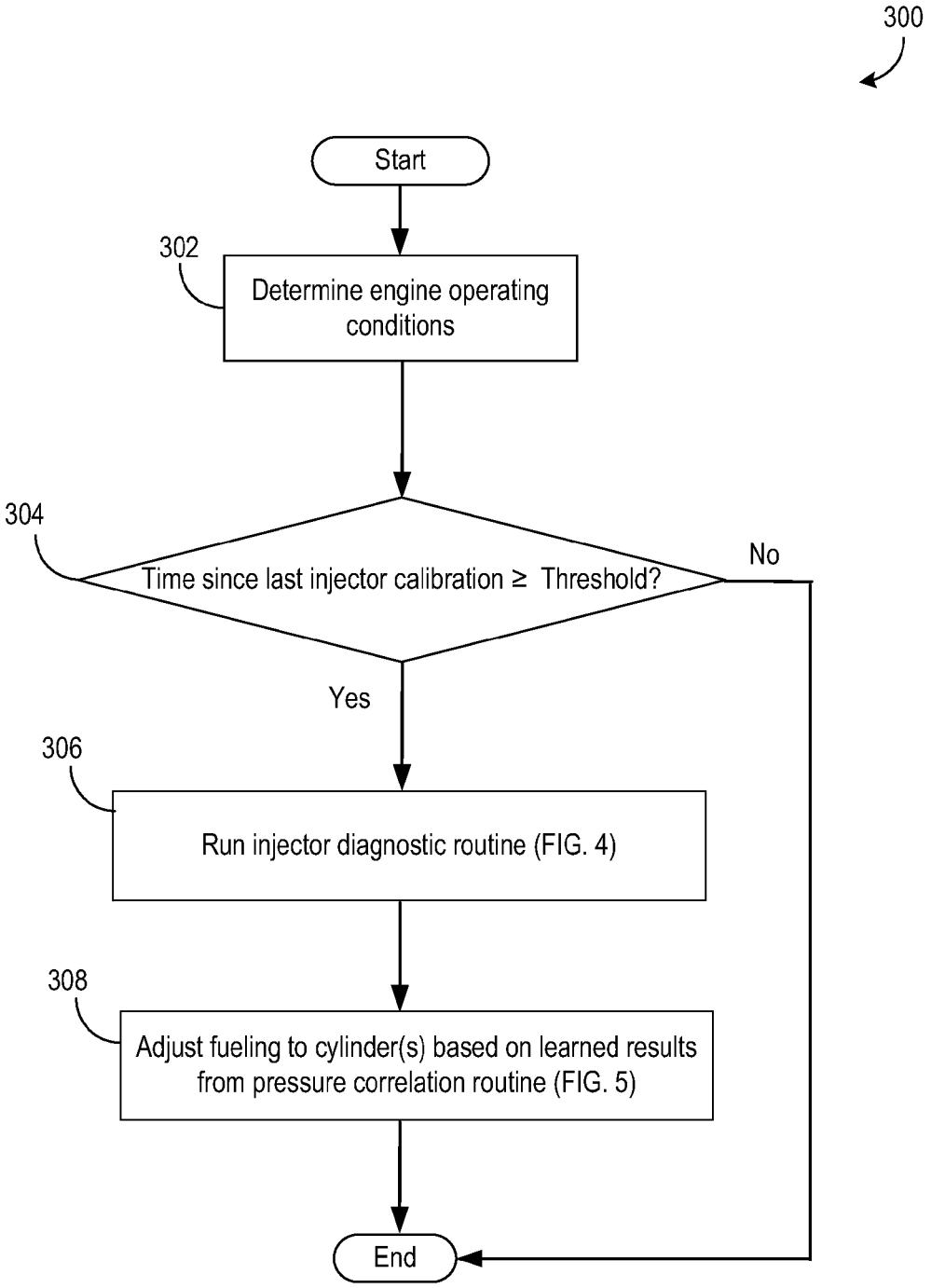
FIG. 3 is an example flowchart illustrating a routine that confirms the need of an injector calibration event and performs it based on selected conditions.
Figure 4:
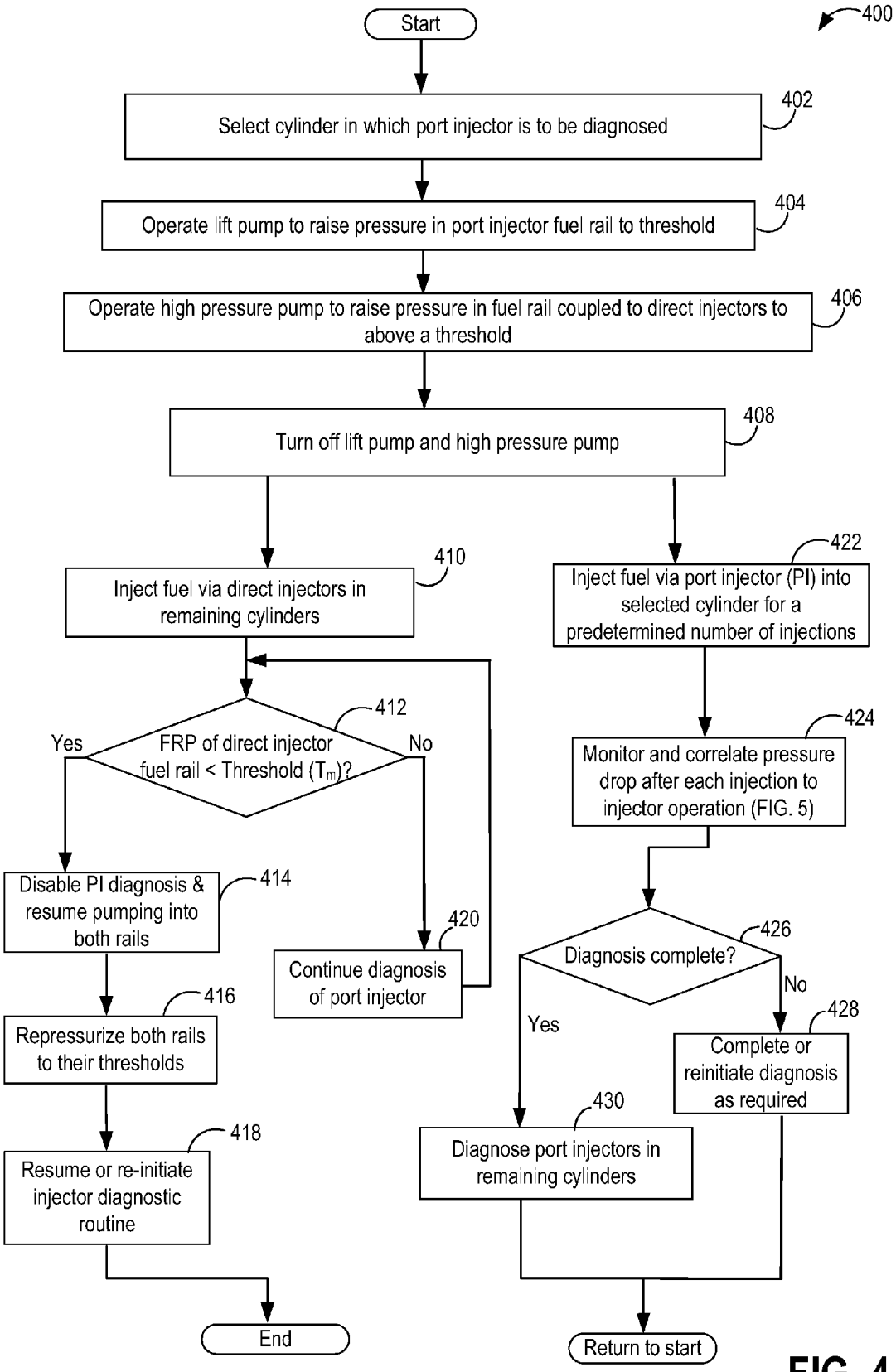
FIG. 4 presents a flowchart demonstrating an example port fuel injector diagnostic routine.
Figure 5:
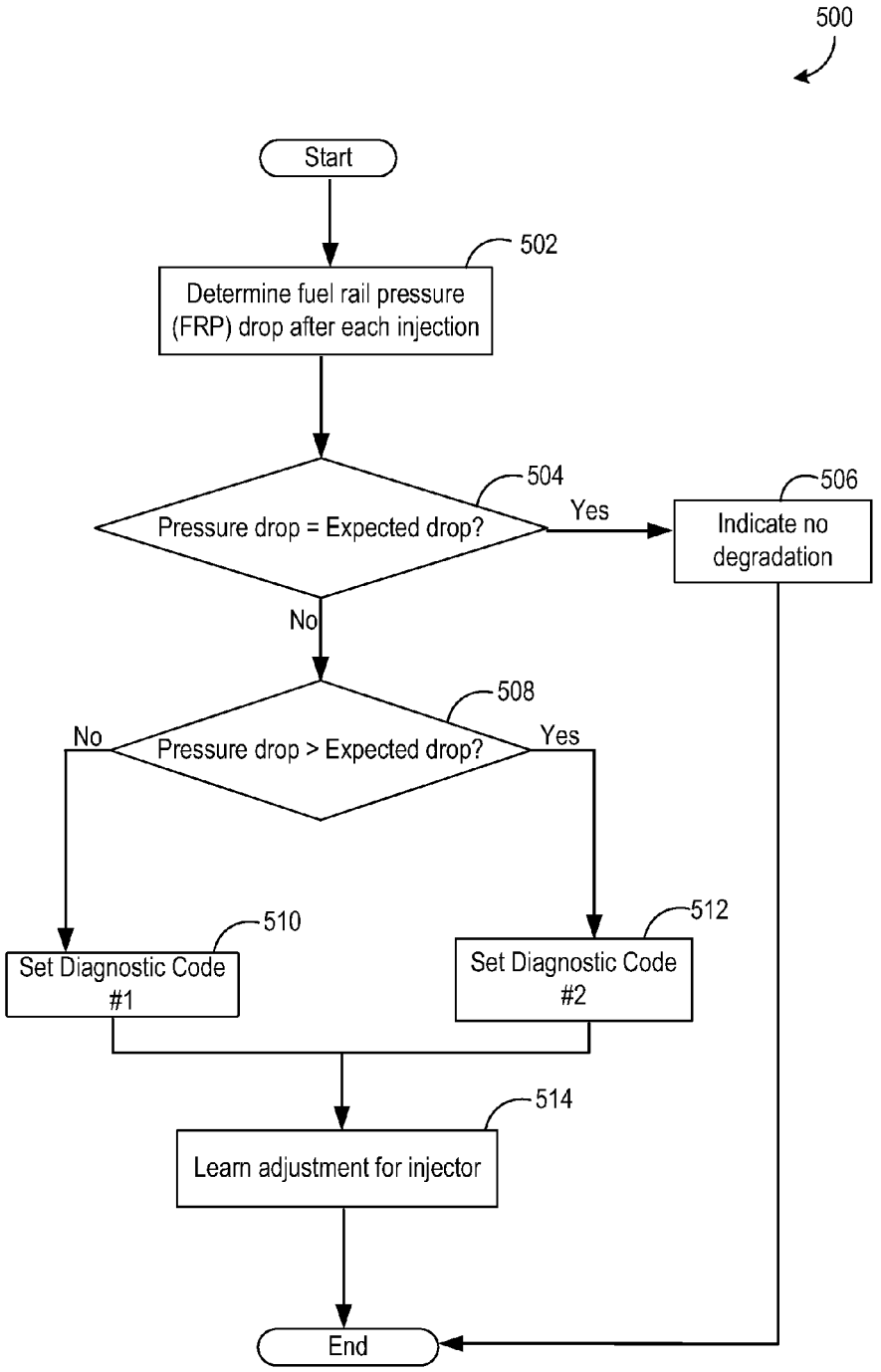
FIG. 5 shows a flowchart depicting an example correlation between fuel pressure drop and port injector operation.

Example routines that may be performed by controller 12 to evaluate injector operation are shown in FIGS. 3-5. Routine 300 in FIG. 3 verifies whether a port injector diagnostic can be performed based on engine operating conditions. Meanwhile, routine 400 in FIG. 4 performs a port fuel injector diagnostic while routine 500 in FIG. 5 correlates a measured pressure drop in fuel rail pressure (FRP) at the low pressure fuel rail to port injector performance.

At FIG. 3, an example routine 300 determines if an injector diagnostic routine can be initiated based on existing engine operating conditions. Specifically, routine 300 determines if a diagnostic routine is desired based on an amount of time since the last injector calibration.

At 302, engine operating conditions may be determined. Engine operating conditions may include engine load, engine temperature, engine speed, etc. For example, a controller may decide to not activate a fuel injector diagnostic routine if the engine is operating under high loads. Once engine operation conditions are estimated, routine 300 proceeds to 304 where it may be assessed if the time since the last injector calibration is greater than or equal to a predetermined threshold. As examples, injector calibration may be desired one or more times per drive cycle, every other drive cycle, or after a predetermined number of miles is driven.

If the time since the last injector calibration is not greater than or equal to the predetermined threshold, routine 300 ends. In contrast, if sufficient time has elapsed, routine 300 proceeds to 306 where an injector diagnostic routine is carried out, as will be described below with reference to FIG. 4. The injector diagnostic routine may be repeated multiple times and for each diagnostic test, an injector error (slope or offset) may be determined. This error may be averaged over the multiple repetitions allowing for higher precision of injector correction. At 308, upon completing the diagnostic routine, an injection amount via the calibrated injector may be adjusted based upon a learning from the diagnostic routine, as elaborated at FIG. 5.

Continuing now to FIG. 4, a diagnostic routine 400 is illustrated for evaluating the performance of port fuel injectors in a single fuel, dual injector per cylinder, dual rail system. Specifically, the fuel rail pressure in both a high pressure and low pressure fuel rail is elevated to a preset level, all pumping is then suspended and fuel is injected into a single cylinder via a port injector in order to detect a pressure drop in the low pressure rail due to the injection. As such, the other cylinders of the engine may continue to be fueled by their respective direct injectors and the diagnostic routine may be carried out using one port injector at a time, thereby, maintaining engine efficiency. Each port injector of the engine system may be sequentially diagnosed. It will be appreciated that the diagnostic routine may be performed to diagnose a single cylinder at a time (as shown) or a bank of cylinders at a time.

At step 402, a cylinder may be selected for port injector diagnostics. The cylinder may be selected based on time elapsed since a previous diagnosis of the corresponding port injector. At 404, the lift pump may be operated to increase fuel pressure within the system to a threshold (e.g., a maximum pressure). For example, a full voltage pulse may be applied to an electronic lift pump such that fuel pressure within the low pressure plumbing compliance is at a threshold. The plumbing compliance includes a low pressure fuel rail coupled to port injectors.

At 406, a high pressure pump coupled to a high pressure fuel rail and direct injectors may be operated to increase pressure within the high pressure fuel rail to a threshold. Direct injectors may typically operate at higher pressures than port injectors. Therefore, the threshold pressure for the high pressure fuel rail may be higher than the threshold for the low pressure fuel rail coupled to port injectors. For example, the port injector fuel rail may be pressurized to about 7 bar whereas the pressure for the direct injector fuel rail may be to about 200 bar. By raising the pressure in the entire fuel system before a calibration event, sufficient fuel may be available for correct metering by the injector and for multiple injection events.

As such, unlike the lift pump system, where fuel is pressurized in the low pressure fuel rail due to a compliance conduit, the high pressure pump system is rigid. This is because the fuel pressure storage in the high pressure system is due to the fuel's bulk modulus. Consequently, by raising the pressure in the high pressure fuel rail sufficiently high (e.g., at a maximum permissible level or above a threshold pressure), the high pressure pump can be transiently turned off even while the direct injectors are supplying fuel to the engine. Since port injector diagnostics require the lift pump to be disabled, and since the lift pump lifts fuel for further pressurization by the high pressure pump, by sufficiently pressurizing the high pressure fuel rail, the high pressure pump and the lift pump can both be disabled during port injector diagnostics without affecting engine fuel delivery via direct injectors.

At 408, the high pressure pump and the lift pump may be shut down concurrently. In another example, the two pumps may be disabled sequentially, for e.g., the lift pump may be turned off first followed by the high pressure pump. Thus, a control volume may exist within the high pressure fuel rail and another control volume of fuel may exist within the low pressure system. For example, referring to FIG. 2, a first control volume of fuel at a higher pressure may be stored in fuel rail 213 and passage 210 whereas a second control volume of fuel may exist within the low pressure system of passages 204 and 208, and fuel rail 211.

After the pumping of fuel is suspended, the selected cylinder may be injected with fuel via only its port injector at step 422. The selected cylinder is fueled solely via its port injector and the direct injector attached to the selected cylinder may be disabled during the diagnostic routine. Fuel may be injected into the single cylinder for a predetermined number of injections. This number may depend on the pulse width of the injection. For example, fewer injections may be applied if a larger pulse width of injection is used, while more injections may be applied if a smaller pulse width of injection is used. Alternatively, the number of injections may be adjusted based on the commanded fuel injection volume, the number of injections decreased as the commanded fuel injection volume increases.

Simultaneously, the remaining cylinders of the engine may receive fuel via each of their respective direct injectors, at 410, while their respective port injectors are deactivated. All cylinders may be fueled by a common fuel since the system is a single fuel system. For example, if the port injector within cylinder 1 of a 4-cylinder engine is selected for calibration, cylinder 1 may be fueled via its port injector while cylinders 2, 3, and 4 may receive fuel from their direct injectors. Thus, referring to FIG. 2, if port injector 215*a* is being evaluated, cylinder 212*a* is fueled via port injector 215*a* while direct injector 214*a* is disabled. Further, cylinders 212*b*, 212*c* and 212*d* are injected via direct injectors 214*b*, 214*c* and 214*d* respectively while port injectors 215*b*, 215*c* and 215*d* are deactivated.

At 424, pressure drops within the low pressure fuel rail supplying fuel to the port injector being diagnosed may be monitored after each injection and correlated with injector operation. For example, the controller may receive signals from the pressure sensor coupled to the low pressure fuel rail which senses the change in fuel rail pressure (FRP) after each injection. The correlation with injector performance will be described later in reference to FIG. 5.

At 426, it may be determined if the port injector diagnosis is complete. In one example, a diagnosis may be completed when a satisfactory number of pressure drop readings are obtained. If the diagnosis is completed for the selected port injector, at 426, routine 400 may decide to diagnose port injectors in the remaining cylinders and pump operation may be restored before returning to start. For example, the controller may select another cylinder for port injector diagnosis. If at 426 it is determined that the port injector diagnosis is incomplete, the diagnosis may be re-initiated to achieve completion at 428. For example, a diagnosis may be incomplete if it has been disabled due to a reduction in fuel rail pressure within the high pressure rail. The routine may then return to 402 to complete or reinitiate a diagnosis.

Returning now to 412, it may be determined if fuel rail pressure at the high pressure rail is below a lower threshold $T_m$, e.g., below a minimum pressure. For example, the lower threshold $T_m$ may be a minimum pressure required to maintain proper DI fuel injection. As such, due to fuel delivery to multiple cylinders via the direct injectors as compared to fuel delivery to a single cylinder via the port injector, pressure in the high pressure fuel rail may drop faster than the pressure in the low pressure fuel rail. For example, the high pressure fuel rail may fall below the lower threshold multiple times during the diagnosis of a given port injector. As such, when the high pressure fuel rail falls below the lower threshold, there may not be sufficient pressure to sustain cylinder direct injection, leading to degradation of engine performance. In addition, re-pressurization of the high pressure fuel rail may be required before cylinder direct injection (and port injector diagnostics) can be resumed. Pressure drops within the fuel rail coupled to the direct injectors may be monitored at the same time as the low pressure fuel rail pressure is being monitored. In the example of a 4-cylinder engine where one port injector and three direct injectors are enabled, the FRP in the high pressure rail may reduce faster since it is supplying fuel to three injectors. Further, a significant drop in FRP for the high pressure rail may adversely affect engine operation.

If the FRP of the high pressure rail is determined to be higher than the threshold, at 420 port injector diagnosis may be continued and the routine returns to step 412.

If the FRP in the high pressure fuel rail is determined to have fallen below the lower threshold $T_m$, at 414 the port injector diagnostic may be disabled and fuel pumping may recommence. At 416, both the lift pump and the high pressure pump may be operated and the two rails may be re-pressurized to their respective thresholds. At 418, after sufficiently re-pressurizing the high pressure fuel rail, the port injector diagnostic routine may be resumed. In one example, readings obtained until step 414 may be stored and added to readings collected after the diagnostic is resumed at 418. In another example, any measurements obtained prior to step 414 may be discarded and the entire calibration event may be re-initiated at 418.

In this way, a port injector within a single cylinder may be diagnosed while remaining engine cylinders are fueled by their respective direct injectors. By isolating the port injector, only one port injector can be evaluated while the remaining port injectors are disabled. This reduces interference from pulsation in the fuel rail when multiple injectors are firing. In order to maintain engine operation and driveability, the port injector diagnostic is conducted for the duration that FRP within the high pressure rail remains above a lower threshold, and while direct fuel injection of the remaining cylinders is possible. The diagnostic may be temporarily disabled and pump operation may be resumed if the FRP of the fuel rail coupled to the direct injectors falls below the lower threshold.

Turning now to FIG. 5, an example routine 500 is shown for correlating a pressure drop at a low pressure fuel rail with port injector performance. Specifically, pressure drops in the low pressure rail after each injection are compared to an expected drop to evaluate whether a port injector is injecting a desired (or commanded) amount of fuel.

At 502, the fuel rail pressure (FRP) drop in the low pressure fuel rail may be measured after each injection. It will be appreciated that in alternate examples, the change in fuel rail pressure at the low pressure rail may be estimated after a defined number of injection pulses, such as every 2 or 3 pulses. As such, the number may be dependent on the pulse width (or the commanded fuel volume injection amount) of each port injection pulse. Thus, if the pulse width is higher, the change in FRP may be estimated more frequently (after a fewer number of injection pulses) while if the pulse width is lower, the change in FRP mat be estimated less frequently (after a larger number of injection pulses). Since all fuel pumping is suspended during the diagnostic, the amount of fuel, and thus the FRP, decreases with each injection from the port injector. FIG. 6A shows an example port injector calibration in which one port injector coupled to a single cylinder is fired in a predetermined sequence while the remaining cylinders are injected via their direct injectors. FIG. 6B depicts subsequent pressure drops in each fuel rail.

Map 600 of FIG. 6A shows fuel injection timing plotted on the y-axis and cylinder number plotted on the x-axis. The example depicted is for a 4-cylinder engine where each cylinder includes a direct injector and a port injector. The top plot 602 represents a firing sequence for direct injectors and each portion of fuel injection via a direct injector is depicted by a dotted block. The bottom plot 604 of FIG. 6A represents a firing sequence for port injectors and each portion of port injected fuel is shown as a diagonally striped block. Line 603 represents the beginning of a port injector calibration sequence corresponding to time t1 of map 610. Line 605 represents a timing corresponding to t2 of map 610. Map 610 of FIG. 6B shows fuel rail pressure (FRP) plotted on the y-axis against time on the x-axis. Plot 612 illustrates the change in FRP within a low pressure fuel rail as a port injector fires into a single cylinder during calibration. Plot 614 depicts the change in FRP within a high pressure fuel rail as multiple direct injectors fuel the remaining three cylinders.

Prior to t1, denoted on FIG. 6A by line 603, during normal engine operation, each cylinder may be fueled via both injectors and fuel pressure in both rails may be maintained at initial operating pressures. At line 603, based on engine operating conditions being met, a port injector calibration sequence may commence for the port injector within cylinder 1. During the calibration event, cylinder 1 may exclusively receive port injected fuel while cylinders 2, 3 and 4 receive direct injected fuel.

As shown in map 610 of FIG. 6B, fuel rail pressure may be increased to a threshold level in each of the two fuel rails prior to the start of the calibration event. Pressure in the low pressure fuel rail coupled to port injectors may be increased from an initial level of PI_Pi to an upper threshold level of PI_Po. Similarly, pressure in the high pressure fuel rail coupled to direct injectors may rise from an initial DI_Pi to a threshold level of DI_Po. The threshold pressure in the high pressure rail, DI_Po, is higher than the threshold pressure in the low pressure fuel rail, PI_Po. After both rails are pressurized to their respective upper thresholds, all fuel pumping is suspended until the calibration event for the given port injector is completed or disabled.

After each injection, pressure in each of the fuel rails may experience a drop as shown in FIG. 6B. Port injector performance may be evaluated by correlating a pressure drop after each injection to an expected drop. For example, at time t2, drop in FRP after an injection via the port injector (represented at line 605 on map 600) may be calculated as the difference between P1, the pressure before the injection event, and P2, the pressure immediately after that injection event. An average of multiple pressure readings prior to and after an injection event may be obtained for higher precision while calculating the pressure drops.

Pressure drops within the high pressure fuel rail may be simultaneously monitored to ensure that sufficient fuel is available to sustain engine operation as the calibration event is performed with fuel pumping being shut down.

Returning again to routine 500, after a FRP drop is determined at each injection, each pressure drop may be compared to an expected pressure drop at 504. If the measured pressure drop is comparable to an expected drop, at 506 the routine may indicate that the injector is healthy and the routine may end. On the other hand, if it is established that the observed pressure drop is different from the expected drop, at 508, it may be determined if the observed pressure drop is more than an expected drop. If the estimated pressure drop is more than an expected amount, at 510, a first diagnostic code (code #1) may be set by the controller. For example, the measured pressure drop may be more than expected when an injector is stuck open and more fuel than desired is injected. Accordingly, the first diagnostic code may indicate that the port injector is delivering more fuel than commanded. If the observed pressure drop is less than the expected drop, at 512 the controller may set a second diagnostic code (code #2). For example, the estimated pressure drop may be smaller than an expected drop when an injector is partially clogged and less fuel than desired is injected. Accordingly, the second diagnostic code may indicate that the port injector is delivering less fuel than commanded.

At 514, an adjustment for the port injector may be learned based on the diagnostic codes set at steps 510 and 512. For example, if the first diagnostic code was set, and it was determined that the port injector over-injected fuel, the controller may learn a difference between the expected amount of port fuel injection and the actual amount of port injection based on the change in fuel rail pressure. During subsequent fuel injection, the pulse width and duty cycle of the port injector may be adjusted based on the learned difference to compensate for the over-fueling. For example, the fuel injection pulse width may be reduced as a function of the learned difference. In an alternate example, if the second diagnostic code was set, and it was determined that the port injector under-injected fuel, the controller may learn a difference between the expected amount of port fuel injection and the actual amount of port injection based on the change in fuel rail pressure. During subsequent fuel injection, the pulse width and duty cycle of the port injector may be adjusted based on the learned difference to compensate for the under-fueling. For example, the fuel injection pulse width may be increased as a function of the learned difference.

Routine 500 may be performed after each injection by the port injector being calibrated to generate sufficient readings enabling a more accurate diagnosis of injector performance. The number of injections that can occur during a calibration event may further depend on the FRP drop within the high pressure fuel rail. Fueling via the characterized injector may be adjusted at the end of a calibration event based on the diagnosis.

As such, the completion of a port injector calibration event depends on the duration that direct injectors can continue to be fueled with the high pressure pump and lift pump disabled. This is based on the duration for which the high pressure fuel rail remains at or above a desired pressure to maintain consistent engine operation. A significant reduction in FRP of the high pressure fuel rail coupled to the direct injectors can have adverse effects on engine operation. Therefore, the FRP of the high pressure fuel rail is constantly monitored as a calibration is performed and calibration may be discontinued if the FRP falls below a predetermined lower threshold. FIG. 7 depicts an instance where a calibration event in a cylinder completes and FIG. 8 portrays an instance when the calibration may be disabled and restarted based on dissipation of FRP in the high pressure fuel rail.

Map 700 of FIG. 7 shows fuel rail pressure (FRP) for the two rails plotted along the y-axis and time plotted along the x-axis. Plot 702 shows a pressure variation in a low pressure fuel rail (coupled to engine port injectors) during a port injector calibration event and plot 704 shows a pressure variation in a high pressure fuel rail (coupled to engine direct injectors) during the same calibration event. Line 703 represents a lower threshold pressure $T_m$ (e.g., a minimum pressure) for the high pressure fuel rail. The lower threshold represents a minimum pressure required for proper direct injection. A calibration event may be discontinued upon FRP in the high pressure fuel rail coupled to direct injectors falling below the lower threshold $T_m$.

Prior to t1, an engine may be operating under normal conditions without any calibration event. At t1, a calibration event for a port injector in cylinder 1 may commence whereupon the two fuel rails are pressurized from respective initial pressures (PI_Pi, and DI_Pi) to respective upper thresholds (PI_Pm, and DI_Pm). Thus, FRP in both rails increases at t1. The lift pump and high pressure pump may then be shut down to suspend further fuel rail pressurization. Between t1 and t2, the port injector may inject fuel into cylinder 1 and a pressure drop after each injection may be measured and correlated to an expected drop. At the same time, FRP in the high pressure rail coupled to direct injectors experiences a decrease due to fuel being direct injected into each of the remaining cylinders of the engine. At t2, the calibration event within cylinder 1 is completed before FRP within the high pressure rail falls below threshold 703. Thereafter, the controller may initiate calibration of the port injector within cylinder 2. Therefore, at t3, both fuel rails are re-pressurized to their respective upper thresholds and pump operation is re-suspended. Calibration of a port injector within cylinder 2 may now be performed while the remaining cylinders are fueled via their respective direct injectors.

As such, pressure pulses ringing in the fuel rail can increase the signal processing requirements for measuring the pressure before and after the injection (whether in the high pressure or low pressure fuel rail). By introducing material in the fuel rail with damping properties, the material may damp wave energies, thereby simplifying the pressure measurements. For example, the fuel rail may be at least partially filled with the wave-damping media. One example of such a damping material that may be introduced into the fuel rail includes flat stainless steel wire that is curled. Still other materials with appropriate damping properties may be used.

Map 800 of FIG. 8 is similar to map 700 of FIG. 7 and depicts fuel rail pressure (FRP) for the two rails along y-axis and time along the x-axis. Plot 802 shows a pressure variation in the low pressure fuel rail during a port injector calibration event and plot 804 shows a pressure variation in the high pressure fuel rail during the same calibration event. Line 703 represents the lower threshold pressure $T_m$ (e.g., a minimum pressure) for the high pressure fuel rail. A calibration event may be discontinued if the FRP in the high pressure fuel rail coupled to direct injectors falls below the lower threshold.

Prior to t11, the engine may be operating under normal conditions without any calibration event being performed. At t11, a calibration event for a port injector in cylinder 1 may commence whereupon the two fuel rails are pressurized to a threshold. Thus, FRP in both rails increases at t11. The lift pump and high pressure pump may then be shut down to suspend further pressurization of the fuel rails. Between t11 and t12, the port injector may inject fuel into cylinder 1 and a pressure drop after each injection may be measured and correlated to an expected drop. At the same time, FRP in the high pressure rail coupled to direct injectors experiences a decrease with each injection due to fuel being direct injected into each of the remaining cylinders of the engine. At t12, the direct injector FRP within the high pressure rail falls below threshold 703. Therefore, the calibration event may be disabled at t12 in response to high pressure fuel rail FRP reducing below threshold 703. Also at t12, both the lift pump and the high pressure pump are operated to re-pressurize both fuel rails to their respective thresholds after which pump operation is suspended. The disabled port injector calibration event within cylinder 1 is then resumed (as shown). Alternatively, a new event may be initiated. Thus, injector diagnosis with pressure correlation is performed as long as FRP within the high pressure rail remains above a lower threshold.

In this way, the performance of a cylinder port injector can be evaluated while maintaining engine fueling via direct injection with each of a lift pump and a high pressure pump disabled. In particular, by sufficiently pressurizing a high pressure fuel rail prior to port injector diagnostics, a rigid high pressure fuel system containing a fuel with a given bulk modulus can be used to deliver fuel to engine cylinders via respective direct injectors even while a high pressure pump and a lift pump are disabled. By sufficiently pressurizing a low pressure fuel rail and selectively enabling only one port injector of a cylinder, while disabling all other port injectors, each port injector may be individually isolated and characterized. By frequently re-pressurizing the high pressure fuel rail, with a transient disabling of port injector diagnostics, each port injector can be calibrated non-intrusively, without degrading engine operation. By characterizing each port injector, injector health may be improved and injector fueling accuracy may be enhanced.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, 1-4, 1-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine with two fuel injectors per cylinder comprising:

pressurizing a first fuel rail with each of a first and second pump;

pressurizing a second fuel rail with only the first pump; and after suspending operation of both pumps, injecting a common fuel via a single injector, coupled to the second fuel rail, into a single cylinder; and correlating pressure drop in the second fuel rail to injector operation.

2. The method of claim 1, wherein the first pump is a lift pump and the second pump is a high pressure pump, wherein the correlating includes indicating degradation of the single injector in response to an estimated pressure drop in the second fuel rail being different from an expected pressure drop, wherein after suspending includes immediately after suspending operation of both pumps.

3. The method of claim 2, wherein the two fuel injectors per cylinder include a first direct injector coupled to the first fuel rail and a second port injector coupled to the second fuel rail, and wherein injecting the common fuel into the single cylinder via the single injector includes port injecting fuel via the second port injector of the single cylinder.

4. The method of claim 3, further comprising, direct injecting the common fuel from the first rail to all but the single cylinder of the engine via the first direct injector of all but the single cylinder of the engine, wherein injecting the common fuel includes injecting the same common fuel via the direct injector and port injector.

5. The method of claim 4, further comprising, monitoring a pressure of the first fuel rail while direct injecting the common fuel to all but the single cylinder of the engine, and in response to the first fuel rail pressure falling below a lower threshold, resuming operation of the first and second pumps and at least temporarily disabling diagnosing the second port injector of the single cylinder.

6. The method of claim 2, wherein the correlating further includes setting a first diagnostic code to indicate the single injector is partially clogged when the estimated pressure drop is smaller than the expected pressure drop; and setting a second diagnostic code to indicate the single injector is stuck open when the estimated pressure drop is larger than the expected pressure drop.

7. The method of claim 3, further comprising adjusting fuel injection to the single cylinder via the second port injector based on the correlating, and wherein the first and second fuel rails are filled with a wave-damping media.

8. The method of claim 7, wherein the adjusting includes increasing fuel injection into the single cylinder via the second port injector when the estimated pressure drop is lower than the expected pressure drop, and decreasing fuel injection into the single cylinder via the second port injector when the estimated pressure drop is higher than the expected pressure drop.

9. The method of claim 1, wherein pressurizing the first fuel rail includes pressurizing to a first threshold pressure, and wherein pressurizing the second fuel rail includes pressurizing to a second threshold pressure, the first threshold pressure of the first fuel rail higher than the second threshold pressure of the second fuel rail.

10. The method of claim 1, wherein injecting fuel into the single cylinder via the single injector includes injecting fuel as a number of injections, the number based on commanded fuel injection volume.

11. A method for an engine, comprising:

after pressurizing each of a first and second fuel rail with a common fuel, suspending pumping of fuel into both fuel rails;

port injecting fuel from the second fuel rail to only a first cylinder while direct injecting fuel from the first fuel rail to all remaining cylinders; and while a pressure of the first fuel rail remains above a threshold, correlating operation of a port injector of the first cylinder based on a decrease in pressure at the second fuel rail.

12. The method of claim 11, further comprising, when the pressure of the first fuel rail falls below the threshold, disabling the correlating and resuming pumping of fuel into both fuel rails.

13. The method of claim 12, further comprising, after the first fuel rail pressure is returned above the threshold, re-suspending pumping of fuel into both fuel rails and resuming the correlating.

14. The method of claim 11, wherein the correlating includes indicating degradation of the port injector of the first cylinder when the decrease in pressure is higher than a threshold.

15. The method of claim 11, wherein the correlating includes indicating degradation of the port injector of the first cylinder when the decrease in pressure is lower than a threshold.

16. The method of claim 11, wherein pressurizing each of the first and second fuel rail includes pressurizing the first fuel rail via each of a high pressure pump and a lift pump and pressurizing the second fuel rail via only the lift pump; and wherein suspending pumping of fuel into both fuel rails includes disabling each of the high pressure pump and the lift pump simultaneously; and maintaining both pumps disabled during the correlating.

17. The method of claim 16, wherein each engine cylinder includes a port injector and a direct injector, and wherein the first fuel rail is coupled to cylinder direct injectors and the second fuel rail is coupled to cylinder port injectors.

18. The method of claim 11, further comprising, after correlating operation of the port injector of the first cylinder, re-pressurizing each of the first and second fuel rail;

re-suspending pumping of fuel into both fuel rails;

port injecting fuel from the second fuel rail to only a second cylinder while direct injecting fuel from the first fuel rail to all remaining cylinders; and while a pressure of the first fuel rail remains above the threshold, correlating operation of port injector of the second cylinder based on a decrease in pressure at the second fuel rail.

19. A system, comprising:

an engine including a first and a second cylinder;

a port injector and a direct injector coupled to each of the first and second cylinder;

a first fuel rail coupled to the direct injector of each cylinder;

a second fuel rail coupled to the port injector of each cylinder;

a lift pump for pressurizing the first and second fuel rail;

a high pressure pump for further pressurizing the first fuel rail; and a control system with computer-readable instructions stored on non-transitory memory for:

after pressurizing each of the first and second fuel rail;

concurrently suspending operation of both pumps; and during a first condition, fueling the first cylinder via only the port injector while fueling the second cylinder via only the direct injector;

during a second condition, fueling the second cylinder via only the port injector while fueling the first cylinder via only the direct injector; and during both conditions, diagnosing the port injector of each cylinder based on a change in second fuel rail pressure following the fueling.

20. The system of claim 19, wherein during both conditions, a pressure of the first fuel rail is above a threshold pressure, and wherein the diagnosing includes, during the first condition, diagnosing degradation of the port injector coupled to first cylinder based on an estimated drop in second fuel rail pressure being different from an expected drop in second fuel rail pressure; and during the second condition, diagnosing degradation of the port injector coupled to second cylinder based on the estimated drop in second fuel rail pressure being different from the expected drop in second fuel rail pressure.

* * * * *